United States Patent [19]

Tyrer

[11] Patent Number: 5,055,179

[45] Date of Patent: Oct. 8, 1991

[54] UPGRADING HEAVY OIL

[75] Inventor: J. David Tyrer, Oakville, Canada

[73] Assignee: Ortech Corporation, Mississauga, Canada

[21] Appl. No.: 365,314

[22] Filed: Jun. 13, 1989

[30] Foreign Application Priority Data

Jun. 13, 1988 [GB] United Kingdom ..... 8813937

[51] Int. Cl.[5] ..... C10G 45/00

[52] U.S. Cl. ..... 208/254 R; 208/106; 208/113; 208/208 R; 208/251 H; 208/251 R; 208/143; 502/84

[58] Field of Search ..... 208/106, 113, 208 R, 208/254 R, 143, 251 H; 423/415 A; 502/84

[56] References Cited

U.S. PATENT DOCUMENTS

| | | | |
|---|---|---|---|
| 2,369,009 | 2/1945 | Bloch et al. | 208/111 |
| 2,450,316 | 9/1948 | Voorhies, Jr. | 208/111 |
| 3,530,066 | 9/1970 | Kuwala et al. | 208/251 H |
| 3,761,398 | 9/1973 | Munekata et al. | 208/208 R |
| 4,176,090 | 11/1974 | Vaughan et al. | 502/84 |
| 4,248,739 | 2/1981 | Vaughan et al. | 502/84 |
| 4,271,043 | 6/1981 | Vaughan et al. | 502/84 |
| 4,378,308 | 3/1983 | Angevine et al. | 208/213 |
| 4,436,832 | 3/1984 | Jucabs et al. | 502/84 |
| 4,568,448 | 2/1986 | Angevine et al. | 208/213 |
| 4,629,712 | 12/1986 | Pinnavaia et al. | 502/84 |
| 4,666,877 | 5/1987 | Vaughan | 502/84 |
| 4,742,033 | 5/1988 | Harris et al. | 502/84 |
| 4,845,066 | 7/1989 | Fahey et al. | 502/84 |

*Primary Examiner*—Helane E. Myers
*Attorney, Agent, or Firm*—Sim & McBurney

[57] ABSTRACT

Heavy crude oils are upgraded thermally in the presence of water and a polyhydroxy metal bentonite in an autoclave, particularly at a temperature of about 200° to about 300° C.

6 Claims, No Drawings

UPGRADING HEAVY OIL

FIELD OF INVENTION

The present invention relates to the upgrading of heavy oil for use as a refinery feed stock.

Heavy crude oils are viscous hydrocarbons having an API (American Petroleum Institute) viscosity of less than 25°, more particularly less than 20°, a low hydrogen-to-carbon ratio and are contaminated with asphaltenes, resins, sulfur and metals. These oils must first be upgraded to improve feedstock quality for conventional refining.

Procedures which have been employed include distillation, visbreaking, catalytic cracking, coking and hydrocracking. In one such conventional procedure, heavy oil is upgraded by use of a transition metal catalyst, hydrogen and temperatures in excess of about 400° C. Such prior art procedures are energy intensive, often require the use of an expensive catalytic material and consume a significant quantity of heavy oil.

SUMMARY OF INVENTION

A new process for upgrading heavy oils has been found which enables a higher quality product oil to be produced rapidly at lower temperatures than conventionally used for catalytic upgrading procedures.

In accordance with the present invention, there is provided a process for upgrading a heavy oil to form a refinery feed stock, which comprises heating the heavy oil in the presence of water and a polyhydroxy metal bentonite.

In the present invention, hydrolysis rather than catalyzed thermal cracking is employed to upgrade heavy oil, which is advantageous since lower temperatures may be employed and the presence of hydrogen is unnecessary, thereby improving the cost-effectiveness of the process. In addition, the process of the invention is more efficient than prior procedures in terms of the extent of upgrading and the quality of oil produced.

The upgrading of oil for forming refinery feed stock is characterized by heteroatom removal (i.e. removal of sulfur, nitrogen and oxygen), a decrease in asphaltene and resin components, improved light and medium oil yields and an increase in hydrogen-to-carbon ratio. The product produced by the process of the invention possesses these characteristics.

GENERAL DESCRIPTION OF INVENTION

The heavy crude oil, water and catalyst mixture usually is heated at a temperature not exceeding about 300° C., preferably about 200° to about 300° C. Such temperature range is significantly lower than conventionally used in catalytic upgrading procedures.

At such elevated temperature, it is necessary to effect the process under an elevated pressure in order to retain the water in the liquid phase. A convenient manner of achieving this result is to carry out the process in an autoclave.

The active or catalytic component used in the present invention is a bentonite clay modified by polyhydroxy metal ions. Such modified clay may be formed by slurrying a quantity of sodium bentonite with a hydrolyzed form of the metal cation. The resulting intercalated clay is washed free of reaction by-products and other impurities and dried for use.

Among the ionic species which may be employed in the present invention are zirconium, aluminum, chromium, iron and nickel. It is preferred to employ polyhydroxy zirconium bentonite and polyhydroxy aluminum bentonite in the process of the present invention.

The polyhydroxy metal bentonite is employed in the present invention in the form of an aqueous slurry with the heavy crude oil. The intercalated polyhydroxy ions in the bentonite provide Lewis acid sites which can form dative bonds with basic sites in the oil, normally in the form of carbon-bonded sulfur, nitrogen or oxygen.

The addition of hydrogen is unnecessary for the upgrading process of the invention, since such hydrogen is produced from the water by reaction with hydrolysis products of the upgrading process. Hydrogen, however, may be added, if desired, with a corresponding lower proportion of water being employed.

The formation of dative bonds between the Lewis acid sites on the clay and basic sites of the oil weakens the carbon-heteroatom bonds, in the heavy crude oil, which then lowers the activation energy required for bond hydrolysis by the water at the elevated temperature of operation of the process. Heavy oils contain significant quantities of such heteroatoms, mainly sulfur, nitrogen and oxygen, particularly in their resin and asphaltene components. The water component of the slurry provides a source of hydrogen, in the form of water-bound hydrogen, to remove the heteroatoms from the oil, mainly in the form of $H_2S$, $NH_3$ and $H_2O$, respectively.

Hydrolysis of the organosulfur content of the heavy oil using the process of the present invention results in the production of carbon monoxide, which in turn is hydrolyzed in the aqueous environment to produce carbon dioxide and hydrogen gas. This hydrogen then is available for in situ hydrogenation of the unsaturated bonds of the oil, and replaces the gaseous hydrogen conventionally employed.

The combination of heteroatom removal and in situ hydrogenation using the modified bentonite clay slurry in the process of the invention improves the stock quality of the oil for refinery upgrading.

The proportions of crude oil, clay and water may vary widely, although the efficiency of upgrading varies as a result. As will be seen from the above discussion, it is desirable to provide a sufficient quantity of modified bentonite to supply enough Lewis acid sites to produce dative bonds with a significant proportion of the heteroatoms to permit hydrolysis to occur, with complete removal of heteroatoms from the oil. A lesser quantity of modified bentonite leads to a less efficient upgrading while a greater quantity leads to no further significant improvement.

In addition, it is desirable to provide sufficient water to permit such hydrolysis to occur and to provide sufficient hydrogen to effect hydrogenation. Again, a lesser quantity leads to a less efficient upgrading while, in this case, a greater quantity leads to contamination with the upgraded oil and presents subsequent separation problems.

The optimum quantities of clay and water for a given heavy crude oil depends on the chemistry of the particular heavy crude oil but the proportions required to be used for that crude oil is readily determinable by one skilled in the art having regard to the foregoing considerations.

EXAMPLES

EXAMPLE 1

This Example illustrates the preparation of polyhydroxy zirconium bentonite and polyhydroxy aluminum bentonite.

Sodium bentonite was slurried with a hydrolyzed form of the metal cation, the product was washed free from reaction by-products and dried at 80° C. X-ray diffraction and elemental analyses were preformed on both the intercalated clay and the free bentonite clay to ensure that the polyhydroxy metal bentonites had been successfully prepared.

The results are set forth in the following Tables 1 and 2:

TABLE 1

ELEMENTAL ANALYSES OF BENTONITE AND POLYHYDROXY METAL BENTONITES

| Element | Bentonite Clay (Percent) | Polyhydroxy Zirconium Bentonite (Percent) | Polyhydroxy Aluminum Bentonite (Percent) |
|---|---|---|---|
| Si | 20.0 | 18.0 | 17.0 |
| Fe | 2.3 | 1.6 | 1.8 |
| Ca | 1.6 | 0.1 | 0.3 |
| Mg | 1.3 | 0.9 | 1.5 |
| Al | 7.9 | 7.3 | 13.0 |
| Na | 0.9 | 0.2 | 0.2 |
| K | 0.5 | 0.3 | 0.5 |
| Zr | — | 10.0 | — |
| O | 65.5 | 61.6 | 65.7 |

TABLE 2

INTERLAMELLAR SPACING, $d_{001}$ OF BENTONITE AND POLYHYDROXY METAL BENTONITE CLAYS

| Compound | $d_{001}$ |
|---|---|
| Bentonite Clay | 17.5A° |
| Polyhydroxy Aluminum Bentonite | 18.4A° |
| Polyhydroxy Zirconium Bentonite | 20.0A° |

EXAMPLE 2

This Example illustrates the upgrading of a heavy crude oil.

A static one-gallon 316 stainless steel autoclave was thoroughly steam cleaned and equipped with a calibrated gas sampling loop for the determination of the quantity and quality of produced gases. 250 g of polyhydroxy zirconium bentonite having the characteristics described in Example 1, was slurried in 500 mL of deionized water in the autoclave. After slurry had been achieved, 193.5 g of a 350° C. heavy crude oil was added to the autoclave and the three reactants were thoroughly mixed.

The autoclave then was sealed, briefly evacuated and flushed with anaerobic nitrogen to remove oxygen. The flushing was achieved by pressurizing the autoclave to 500 psia and then depressurizing the autoclave to ambient pressure for a total of five times.

Heaters then were turned on and the autoclave allowed to heat up. As the autoclave heated up, the pressure gradually increased and the experiment was terminated when a pressure of 3000 psia was reached. In the following Table 3, there is set forth the variations of temperature and pressure with time during the experiment:

TABLE 3

VARIATIONS OF TEMPERATURE AND PRESSURE WITH TIME (TO 195.3 g OF OIL, 250 g POLYHYDROXY ZIRCONIUM BENTONITE AND 500 g OF WATER)

| Time (h) | Temperature (°C.) | Pressure (psia) |
|---|---|---|
| 0.00 | 109 | 15 |
| 0.80 | 185 | 300 |
| 1.00 | 200 | 500 |
| 1.50 | 207 | 550 |
| 2.00 | 220 | 700 |
| 2.08 | 230 | 920 |
| 2.10 | 232 | 1000 |
| 2.16 | 234 | 1050 |
| 2.25 | 235 | 1100 |
| 2.33 | 234 | 1090 |
| 2.41 | 232 | 1090 |
| 2.66 | 240 | 1200 |
| 2.75 | 245 | 1300 |
| 3.00 | 250 | 1500 |
| 3.18 | 250 | 1500 |
| 3.33 | 245 | 1500 |
| 3.62 | 250 | 1520 |
| 3.68 | 252 | 1650 |
| 3.80 | 255 | 1800 |
| 4.00 | 260 | 2000 |
| 4.50 | 260 | 2000 |
| 5.16 | 270 | 2350 |
| 5.66 | 280 | 2700 |
| 6.58 | 290 | 3000 |
| 6.83 | 286 | 3100 |

At the conclusion of the experiment, the autoclave was cooled from 290° to 50° C. The gas sampling loop was used to measure the quantity and quality of the produced gas. The loop was completely evacuated and then filled with a sample of produced gas.

The quantity of produced gas was calculated by expanding the gas into an evacuated calibrated volume. The gas quantity then can be calculated from the observed pressure drop. The gas composition was determined using gas chromatography and is reproduced in the following Table 4:

TABLE 4

GAS COMPOSITION OF PRODUCED GASES RESULTING FROM THE INTERACTION OF HEAVY OIL WITH A POLYHYDROXY ZIRCONIUM BENTONITE/WATER SLURRY

| Gas | Moles of Gas |
|---|---|
| CO | $120 \times 10^{-3}$ |
| $CH_4/CO_2$ | $9.6 \times 10^{-3}$ |
| $C_2H_2$, $C_2H_4$ | $2.8 \times 10^{-3}$ |
| $C_2H_6$ | $46 \times 10^{-3}$ |
| $H_2S$ | $54 \times 10^{-3}$ |
| $C_3H_8$ | $7.2 \times 10^{-3}$ |
| $C_4$-$C_6$ | $120 \times 10^{-3}$ |

The autoclave then was opened and the oil, clay and water were removed. The water was separated from the oil by dissolving the oil/catalyst in methylene chloride. The oil/catalyst was repeatedly Soxhlet-extracted to separate the oil from the catalyst. The methylene chloride was removed slowly from the oil by blowing a stream of nitrogen over the oil/methylene chloride mixture, while heated to a temperature of about 40° C. 138.3 g of upgraded crude of the superior quality was obtained.

SUMMARY OF DISCLOSURE

In summary of this disclosure, the present invention provides a novel procedure for upgrading heavy crude oil by the combination of water and polyhydroxy metal bentonites. Modifications are possible within the scope of this invention.

What I claim is:

1. A process for upgrading a heavy crude oil by hydrolysis to form a refinery feed stock characterized by heteroatom removal, a decrease in asphaltene and resin components, improved light and medium oil yields and an increase in hydrogen-to-carbon ratio (when compared to the heavy crude oil), which comprises heating said heavy crude oil in the presence of water and a polyhydroxy metal bentonite to a temperature of about 200° C. to about 300° C. so as to effect hydrolysis of bonds of heteroatoms in said heavy crude oil and to effect hydrogenation of unsaturated bonds in said heavy crude oil.

2. The process of claim 1 carried out in an autoclave.

3. The process of claim 1 wherein said polyhydroxy metal bentonite is formed by reacting sodium bentonite with a hydrolyzed form of a cation of the metal.

4. The process of claim 3 wherein the metal is selected from zirconium, aluminum, chromium, iron and nickel.

5. The process of claim 2 wherein said polyhydroxy metal bentonite is selected from polyhydroxy zirconium bentonite and polyhydroxy aluminum bentonite.

6. A process for upgrading a heavy crude oil by hydrolysis to form a refinery feed stock characterized by heteroatom removal, a decrease in asphaltene and resin components, improved light and medium oil yields and an increase in hydrogen-to-carbon ratio (when compared to the heavy crude oil), which comprises heating said heavy crude oil in the presence of water and a polyhydroxy metal bentonite so as to effect hydrolysis of bonds of heteroatoms in said heavy crude oil and to effect hydrogenation of unsaturated bonds in said heavy crude oil in the absence of added hydrogen.

* * * * *